US010362857B2

(12) United States Patent
Ohata

(10) Patent No.: US 10,362,857 B2
(45) Date of Patent: Jul. 30, 2019

(54) DEVICE FOR REMOVING OBJECT ON ROAD SURFACE, GUIDE RAIL TYPE VEHICLE, AND METHOD FOR REMOVING OBJECT ON ROAD SURFACE

(71) Applicant: Mitsubishi Heavy Industries Engineering, Ltd., Yokohama-shi, Kanagawa (JP)

(72) Inventor: Mitsuyasu Ohata, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 199 days.

(21) Appl. No.: 15/273,706

(22) Filed: Sep. 23, 2016

(65) Prior Publication Data

US 2017/0129506 A1 May 11, 2017

(30) Foreign Application Priority Data

Nov. 9, 2015 (JP) ..... 2015-219929

(51) Int. Cl.
*A46B 9/02* (2006.01)
*E01H 6/00* (2006.01)
(Continued)

(52) U.S. Cl.
CPC ..... *A46B 9/02* (2013.01); *A46B 3/14* (2013.01); *A46B 7/06* (2013.01); *A46B 7/10* (2013.01);
(Continued)

(58) Field of Classification Search
CPC .... E01H 1/00; E01H 1/02; E01H 1/05; E01H 5/00; E01H 8/00
See application file for complete search history.

(56) References Cited

U.S. PATENT DOCUMENTS 3,825,968 A 7/1974 Larsen
4,218,804 A 8/1980 Arinci et al.
(Continued)

FOREIGN PATENT DOCUMENTS

DE 2242718 A1 3/1973
JP S41-4437 U 3/1966
(Continued)

OTHER PUBLICATIONS

Document to be submitted for the certificate for the application of Exception to Lack of Novelty in JP Patent Application No. 2015-219929, filed Dec. 1, 2015.
Office Action for Japanese Application No. 2015-219929 dated Jun. 4, 2019; 8pp.

*Primary Examiner* — Robert J McCarry, Jr.
(74) *Attorney, Agent, or Firm* — Kanesaka Berner and Partners LLP

(57) ABSTRACT

A device for removing an object on a road surface includes a brush section which is provided at a vehicle body of a guide rail type vehicle traveling on the road surface extends obliquely downward toward the front side in an advancing direction of the vehicle body, and a lower end of the brush section being capable of coming into contact with the road surface; a brush support section that fixes the brush section; a fixing section fixed to the vehicle body; and a connecting section that is interposed between the brush support section and the fixing section to connect the brush support section to the fixing section.

11 Claims, 8 Drawing Sheets

(51) Int. Cl.

| | |
|---|---|
| ***E01H 8/06*** | (2006.01) |
| ***E01H 8/10*** | (2006.01) |
| ***B61B 13/00*** | (2006.01) |
| ***A46B 7/06*** | (2006.01) |
| ***A46B 7/10*** | (2006.01) |
| ***A46B 3/14*** | (2006.01) |
| ***B61F 19/08*** | (2006.01) |
| *B08B 1/00* | (2006.01) |

(52) U.S. Cl.

CPC ..... *B61B 13/00* (2013.01); *B61F 19/08* (2013.01); *E01H 6/00* (2013.01); *E01H 8/06* (2013.01); *E01H 8/10* (2013.01); *A46B 2200/3066* (2013.01); *B08B 1/002* (2013.01)

(56) References Cited

U.S. PATENT DOCUMENTS 4,416,367 A * 11/1983 Easton ..... B65G 45/18 104/279
2010/0258026 A1* 10/2010 Kanemori ..... E01H 8/00 104/279

FOREIGN PATENT DOCUMENTS

| | | | |
|---|---|---|---|
| JP | S55-24906 | U | 2/1980 |
| JP | H1-207509 | A | 8/1989 |
| JP | H3-125425 | A | 12/1991 |
| JP | 6-153307 | A | 5/1994 |
| JP | 2000120037 | A | 4/2000 |
| JP | 2010-241312 | A | 10/2010 |

* cited by examiner

DEVICE FOR REMOVING OBJECT ON ROAD SURFACE, GUIDE RAIL TYPE VEHICLE, AND METHOD FOR REMOVING OBJECT ON ROAD SURFACE

RELATED APPLICATIONS

The present application claims priority to Japanese Patent Application Number 2015-219929, filed Nov. 9, 2015, the disclosure of which is hereby incorporated by reference herein in its entirety.

BACKGROUND OF THE INVENTION

Field of the Invention

The present invention relates to a device for removing an object on a road surface, a guide rail type vehicle, and a method for removing the object on the road surface.

Description of Related Art

As a new transportation means other than a bus or a train, a track-based transportation system that travels on a road surface on a track by traveling wheels made up of rubber tires and the like is known. Such a track-based transportation system is generally referred to as a new transportation system, automated guideway transit (AGT) or the like.

The guide rail type vehicle adopted in such a track-based transportation system, for example, includes a current collecting unit that is provided on a side surface portion, and guide wheels that are provided side by side at the current collecting unit. Moreover, on the track on which the vehicle travels, an electric car line which comes into contact with the current collecting unit of the vehicle to supply power to the vehicle, and a guide rail which guides an advancing direction of the vehicle by the contact of the guide wheels of the vehicle are provided. The guide rail type vehicle travels on the road surface on the track, for example, in an unmanned manner, while being supplied with power by the electric car line, and while being guided by the guide rail.

Here, when snow, foreign matter and the like are present on the road surface on which the traveling wheels roll when the vehicle travels, traveling of the vehicle is impeded. Thus, for example, it is possible to remove the snow and the foreign matter while the vehicle travels, by utilizing a device for removing an object on a track disclosed in Japanese Unexamined Patent Application, First Publication No. 2010-241312.

However, for example, when the snow accumulated on the road surface becomes compacted snow or the foreign matter firmly adheres onto the road surface, it is difficult to sufficiently remove the object on the road surface such as the compacted snow or foreign matter with the conventional removal device. Also, if an operating mechanism for wiping off the compacted snow and foreign matter is separately provided, the structure becomes complicated which causes an increase in cost.

An object of the present invention is to provide a device for removing an object on a road surface, a guide rail type vehicle, and a method for removing an object on a road surface capable of removing the object on the road surface with a simple structure.

SUMMARY OF THE INVENTION

According to a first aspect of the present invention, there is provided a device for removing an object on a road surface that includes a brush section which is provided at a vehicle body of a guide rail type vehicle that travels on the road surface, extends obliquely downward toward the front side in an advancing direction of the vehicle body, and a lower end of the brush section being capable of coming into contact with the road surface.

According to the device for removing the object on the road surface, the brush section extends obliquely forward to come into contact with the road surface. Thus, when the vehicle body travels, the brush section does not advance to simply stroke the road surface. Further, the brush section is able to scrub and remove the object from the road surface. Further, when the lower end of the brush section comes into contact with the road surface, the lower end is pulled to the road surface by the frictional force received from the irregularities of the road surface and is caught at the rear side in the advancing direction. Thereafter, the lower end of the brush section returns to the front again by the restoring force of the brush section itself and acts to flick the road surface. As a result of such an action of the brush section, it is possible to flick off the object from the road surface. That is, by a simple mechanism provided only by inclining the brush section in an obliquely forward direction, it is possible to enhance the effect of removing the object on the road surface, without providing another operating mechanism.

Moreover, in the device for removing the object on the road surface according to a second aspect of the present invention, the device of the first aspect further includes: a brush support section that fixes the brush section; a fixing section fixed to the vehicle body; and a connecting section that is interposed between the brush support section and the fixing section to connect the brush support section to the fixing section, and the connecting section may connect the brush support section to the fixing section to allow a change in the inclination angle of the brush section and the brush support section to the road surface.

By enabling a change in the inclination angle of the brush section and the brush support section by such a connecting section, it is possible to adjust a contact angle of the brush section to the road surface in accordance with an attached state and a deposited state of the object to the road surface. Therefore, it is possible to more effectively remove the object on the road surface.

Further, in the device for removing the object on the road surface according to a third aspect of the present invention, the connecting section of the second aspect may have a cylinder that is interposed between the fixing section and the brush support section to be relatively turnable about an axis extending in a width direction of the vehicle body with respect to the brush support section and the fixing section and is extendable and contractable along the advancing direction of the vehicle body; and an adjusting member that is interposed between the fixing section and the brush support section at a position different from the cylinder in the vertical direction to be relatively turnable about the axis extending in the width direction of the vehicle body with respect to the brush support section and the fixing section and is extendable and contractable in the advancing direction of the vehicle body.

It is possible to push the brush section to the front in the advancing direction or retract the brush section to the vehicle body side, with respect to the fixing section and the vehicle body by expansion and contraction of the cylinder. Further, by providing the adjusting member that relatively turns with respect to the brush support section and the fixing section at a position shifted from the cylinder in the vertical direction, the cylinder and the adjusting member, and the brush support section and the fixing section relatively turn by expanding and contracting the adjusting member to change the position of the lower end of the brush section. This makes it possible to change the inclination angle of the brush section to the road surface. Therefore, it is possible to adjust the contact angle of the brush to the road surface in accordance with the state of the object on the road surface. Thus, it is possible to more effectively remove the object on the road surface.

Further, in the device for removing the object on the road surface according to a fourth aspect, the device of the third aspect may further include a brush back support section that is provided at the fixing section and is capable of supporting the brush section by coming into contact with the brush section at a retracted position of the brush section when the cylinder is contracted.

Because the brush back support section is brought into contact with the back side of the brush section at the retracted position in which the brush section is retracted to the vehicle body side, it is possible to firmly support the brush section at the retracted position. Therefore, it is possible to suppress the rattling of the brush section even when the brush section is not used during traveling of the vehicle body.

Further, in the device for removing the object on the road surface according to a fifth aspect of the present invention, a surface of the lower end of the brush section in one of the first to fourth aspects is provided to extend along the road surface, at a use position in which the brush section is capable of coming into contact with the road surface.

In this way, since the surface of the lower end of the brush section extends along the road surface, the entire surface of the lower end of the brush section can be brought into contact with the road surface. Therefore, it is possible to more effectively remove the object on the road surface.

Moreover, in the device for removing the object on the road surface according to a sixth aspect of the present invention, the surface of the lower end of the brush section of one of the first to forth aspects may be provided in a circular arc shape that forms a convex shape toward a downward direction.

By setting the surface of the lower end of the brush section to an arc shape in this way, even when changing the inclination angle of the brush section, the brush section can be brought into contact with the road surface in a wide range of the surface of the lower end. Thus, it is possible to further enhance the effect of removing the object on the road surface.

Further, in the device for removing the object on the road surface according to a seventh aspect of the present invention, the brush section of one of the first to sixth aspects may have a brush body in which a plurality of linear members are bundled.

Since the vehicle body advances while the lower end of the brush section comes into contact with the road surface, after the lower end is caught at the rear side in the advancing direction so as to be pulled to the road surface, the lower end of the brush section tries to return to the front side by the restoring force of the brush section again and acts to flick the road surface. By using the brush body obtained by bundling the linear members as the brush section, each of the linear members is intricately operated. Therefore, it is possible to further enhance the effect in which the brush section flicks the road surface. As a result, it is possible to more effectively flick off and remove the object from the road surface.

Further, in the device for removing the object on the road surface according to an eighth aspect of the present invention, the brush body of the seventh aspect may be fixed to the brush support section which fixes the brush section to the vehicle body, at a position between the upper and lower ends of the brush body.

Since the brush body is fixed to the brush support section at a middle location between the upper and lower ends of the brush body, when the lower end of the linear member of the brush body is caught at the rear side in the advancing direction, it is easy to obtain a restoring force in which the lower end of the linear member tries to return to the front side. Therefore, it is possible to further enhance the effect in which the brush body flicks the road surface, and it is possible to further improve the removal effect of the object on the road surface.

Moreover, in the device for removing the object on the road surface according to a ninth aspect of the present invention, the brush section of the seventh aspect may further include a binding member that fixes the plurality of linear members at a position between the upper and lower ends of the brush body.

By fixing the linear members together by the binding member at the middle position between the upper and lower ends of the brush body, when the lower end of the linear member is caught at the rear side in the advancing direction, it is easy to obtain a restoring force in which the lower end of the linear member tries to return to the front side. Therefore, it is possible to further enhance the effect in which the brush body flicks the road surface, and it is possible to further improve the removal effect of the object on the road surface.

In the device for removing the object on the road surface according to a tenth aspect of the present invention, the brush section of the seventh aspect may have a first brush group in which a plurality of brush bodies are aligned side by side in the width direction of the vehicle body; a second brush group in which a plurality of brush bodies are aligned side by side in the width direction of the vehicle body and are disposed to be adjacent to the first brush group in the advancing direction; and a binding member that binds the first brush group and the second brush group, wherein the first brush group and the second brush group may be bound by the binding member with a gap in the advancing direction.

The first brush group and the second brush group are provided with a gap in this way. Therefore, as compared to a case where the first brush group and the second brush group are bound together with no gap, the lower ends of the first brush group and the second brush group are easily operated independently when the vehicle body advances while the lower end of the brush section comes into contact with the road surface. Therefore, each of the linear members in the brush section is more intricately operated, and it is possible to further enhance the effect in which the brush section flicks the road surface. As a result, it is possible to more effectively flick off and remove the object from the road surface.

Moreover, a guide rail type vehicle according to an eleventh aspect of the present invention includes the device for removing the object on the road surface of one of the first to tenth aspects; and a vehicle body that fixes the device for removing the object on the road surface.

According to such a guide rail type vehicle, the above-described device for removing the object on the road surface is included. Thus, the brush section does not advance just to stroke the road surface when the vehicle body travels.

Moreover, it is possible to remove so as to scrub the object from the road surface. Further, when the lower end of the brush section comes into contact with the road surface, after the lower end is caught at the rear side in the advancing direction so as to be pulled to the road surface, the lower end of the brush section tries to return to the front side again by the restoring force of the brush section itself, and the brush sections acts to flick the road surface. Thus, it is possible to enhance the effect of removing the object on the road surface with a simple structure.

A method for removing an object on a road surface according to a twelfth aspect of the present invention includes a process of disposing a brush section that is provided at a vehicle body so as to extend obliquely downward toward the front side in an advancing direction of the vehicle body with respect to a road surface on which the vehicle body of a guide rail type vehicle travels and bringing a lower end of the brush section into contact with the road surface; and a process of causing the vehicle body to travel, while bringing the brush section into contact with the road surface.

According to the method for removing the object on the road surface, when the vehicle body travels, the brush section does not advance just to stroke the road, and it is possible to scrub and remove the object from the road surface. Furthermore, the brush section acts to flick the road surface. Thus, it is possible to enhance the effect of removing the object on the road surface with a simple structure.

According to the device for removing the object on the road surface, the guide rail type vehicle, and the method for removing the object on the road surface, it is possible to remove the object on the road surface with a simple structure.

DETAILED DESCRIPTION OF THE INVENTION

A guide rail type vehicle 1 according to an embodiment of the present invention will be described below.

Figure 1:
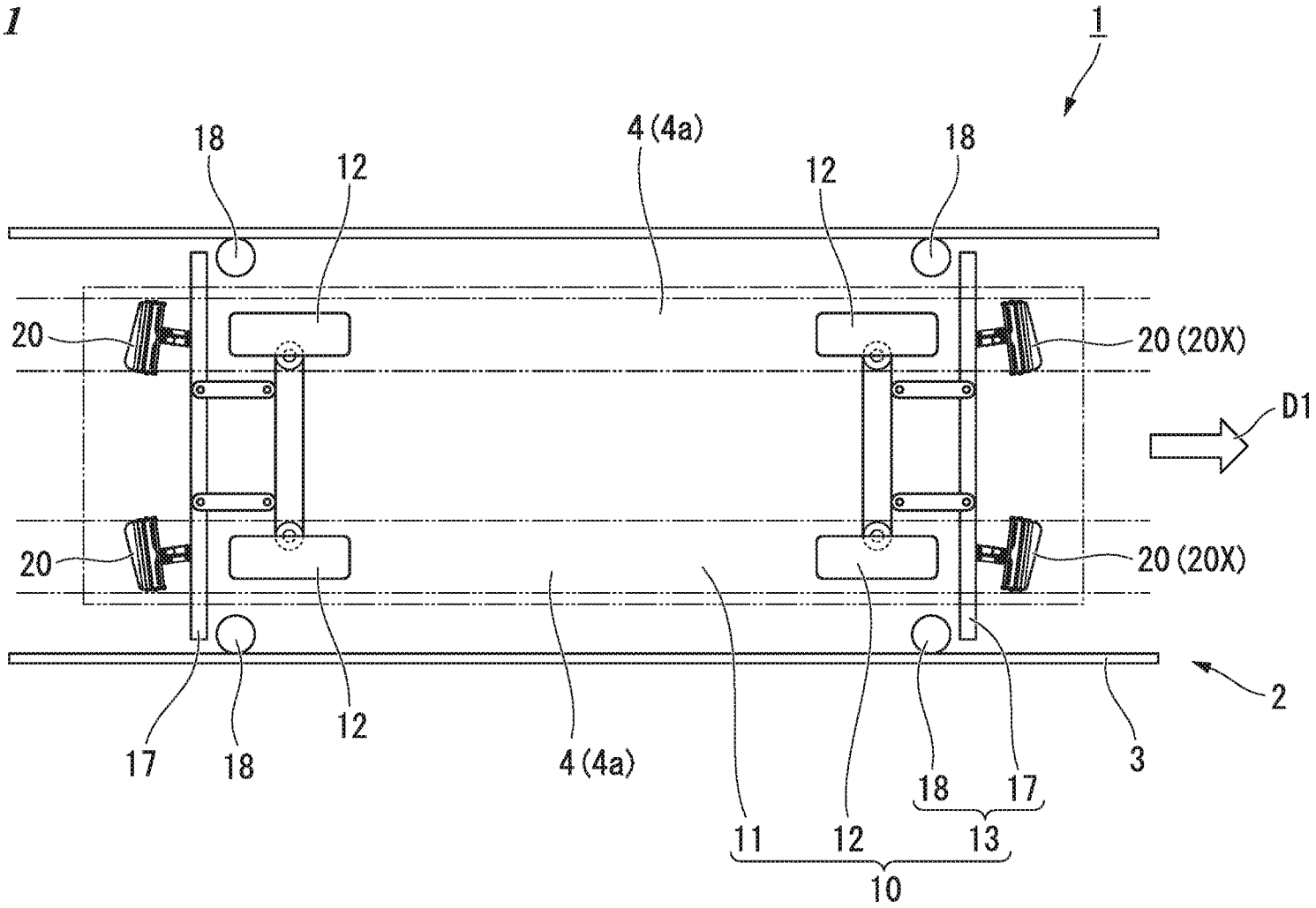
FIG. 1 is an overall top view of a guide rail type vehicle according to an embodiment of the present invention.

As illustrated in FIG. 1, the guide rail type vehicle 1 (hereinafter, simply referred to as a vehicle 1), for example, is a vehicle of a track-based transportation system which travels on a track 2, while being guided by guide rails 3 provided on the track 2.

The track-based transportation system of the present embodiment is a lateral guide rail type (side guide type) transportation system in which the guide rails 3 extending in the extending direction of the track 2 are provided on both side portions in the width direction of the track 2. Although it is not illustrated, the track-based transportation system of the present embodiment may be a central guide rail type transportation system in which the guide rail 3 is provided at the center of the track 2.

The track 2 has a traveling path 4 provided with flat road surfaces 4*a* which are provided substantially horizontal to allow the vehicle 1 to travel.

A pair of traveling paths 4 is provided side by side to be spaced apart from each other in the width direction of the track 2. The traveling paths 4 are provided to protrude vertically upward from a track bottom surface serving as a bottom surface of the track 2. The traveling path 4, for example, is constructed with concrete or the like.

Next, the vehicle 1 will be described.

The vehicle 1 includes a vehicle body 10 that travels on the track 2, and a device 20 for removing the object on the road surface provided at the front and rear portions in the advancing direction D1 of the vehicle body 10.

Here, the advancing direction D1 of the vehicle body 10 in the present embodiment is a direction in which the vehicle body 10 advances, and is an upward direction in FIG. 1.

The vehicle body 10 mainly has a box-shaped body portion 11 having a space therein, an opening and closing door and window or the like (not illustrated) provided on the side surface of the body portion 11, two pairs of traveling wheels 12 on the left and right sides in the width direction provided below the body portion 11, and guide devices 13 that guide the body portion 11 along the track 2.

The traveling wheels 12 turn by being driven by a power source (not illustrated) to roll on the road surfaces 4*a* of the track 2. That is, the traveling wheels 12 are provided at positions corresponding to the positions of the road surfaces 4*a* of the pair of traveling paths 4. For example, rubber tires or the like are used as the traveling wheels 12.

The guide devices 13 include guide frames 17 that are respectively provided at the bottom of the front and rear portions of the vehicle body 10 to support the traveling wheels 12, and guide wheels 18 that are supported by each of the guide frames 17 to be relatively turnable.

The guide frames 17 extend in a vehicle width direction D2 serving as the width direction of the body portion 11 of the vehicle body 10. Both end portions of the guide frame 17 are located outside the traveling wheels 12.

The guide wheels 18 are respectively provided at both ends of the guide frames 17.

Here, the vehicle width direction D2 in the present embodiment is a direction extending along the width direction of the track 2 and is a left-right direction in FIG. 1. Further, the inner side in the vehicle width direction D2 is a central side of the vehicle body 10, and the outer side in the vehicle width direction D2 is a side surface side of the vehicle body 10 as a side on which the guide wheels 18 are provided.

The guide wheels 18 are located outside the side surface of the vehicle body 10, and are supported by the guide frame 17 to be turnable around a turning axis extending in a height direction D3 of the vehicle body 10. The guide wheels 18 are provided substantially at the same height as the guide rails 3. Accordingly, when the vehicle 1 travels, the guide wheels 18 roll by coming into contact with the guide rails 3.

The device 20 for removing the object on the road surface (hereinafter, simply referred to as a removal device 20) is provided by being fixed to the guide frame 17.

Specifically, removal devices 20 are provided as a pair at positions corresponding to the road surfaces 4*a* at outer positions in the vehicle width direction D2, in front of the guide frames 17 provided at the front portion in the advancing direction D1. Similarly, removal devices 20 are provided as a pair at positions corresponding to the road surfaces 4*a* at the outer positions in the vehicle width direction D2, at the rear of the guide frames 17 provided at the rear portion in the advancing direction D1.

Figure 2:
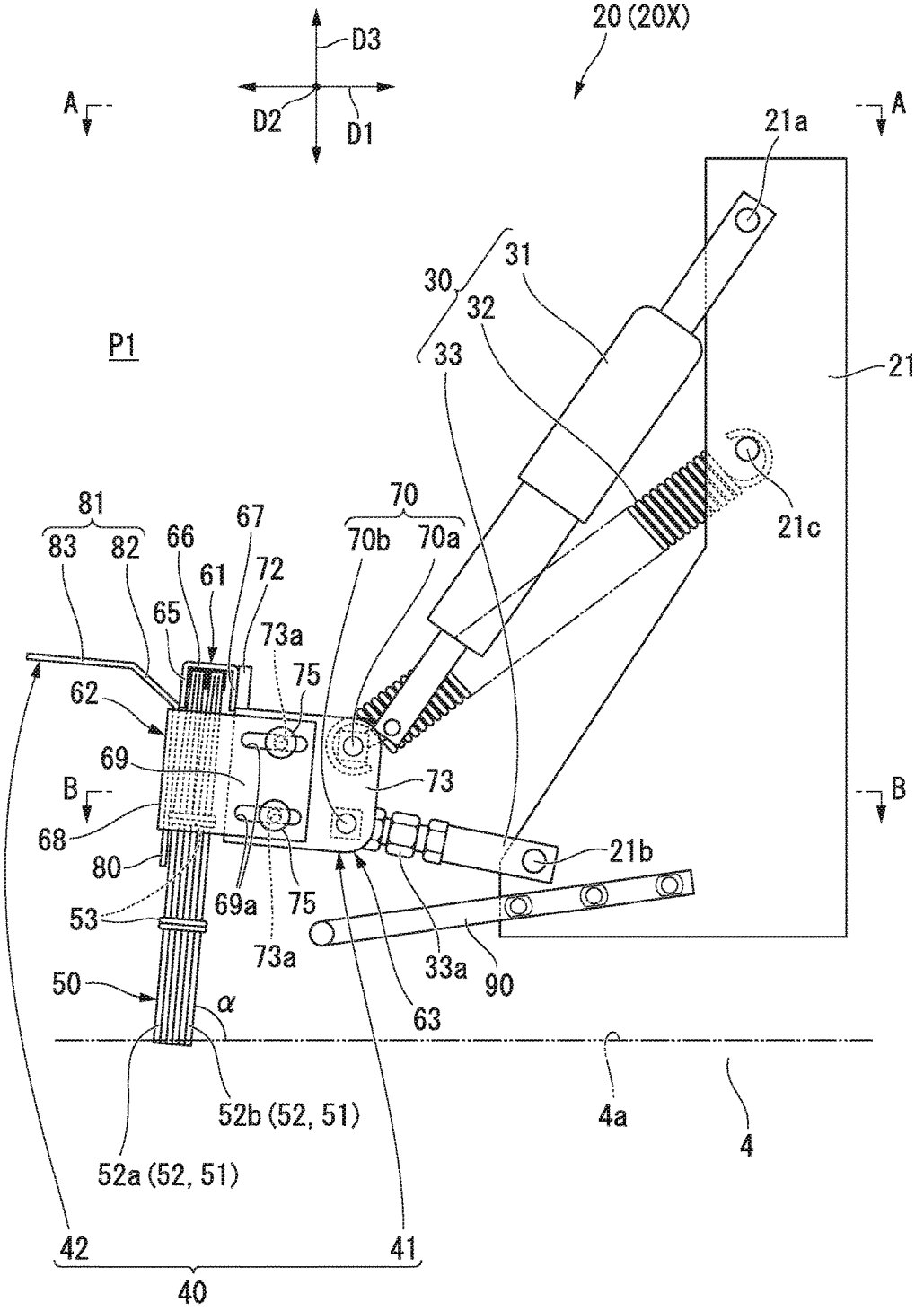
FIG. 2 is a side view illustrating a device for removing the object on the road surface provided in a guide rail type vehicle according to an embodiment of the present invention, illustrating a state in which the brush section is at a use position.
Figure 3:
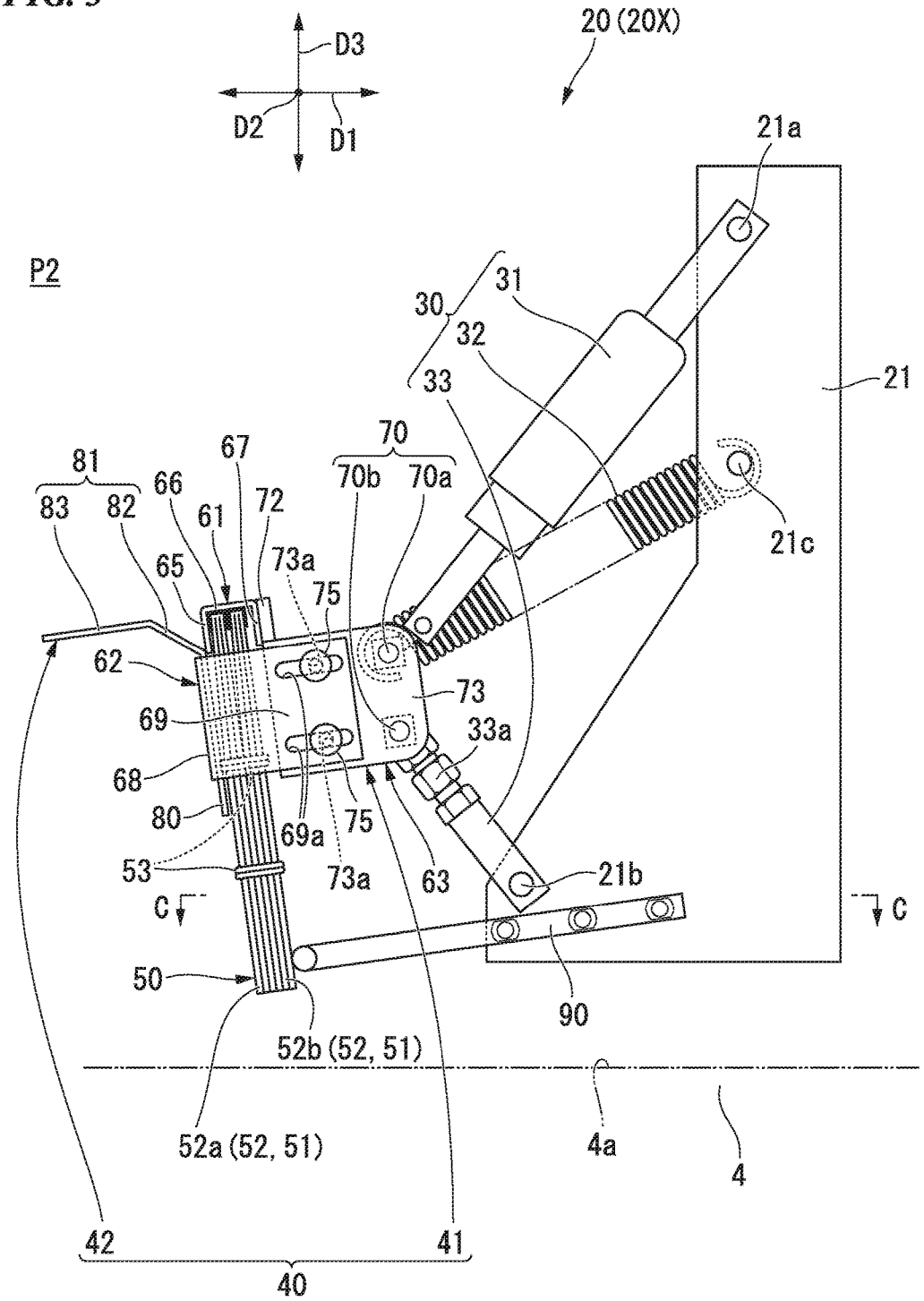
FIG. 3 is a side view illustrating the device for removing the object on the road surface provided in the guide rail type vehicle according to an embodiment of the present invention, illustrating a state in which the brush section is at a retracted position.

As illustrated in FIGS. 2 and 3, each of the removal devices 20 in the present embodiment includes a fixing section 21 fixed to the guide frame 17, a connecting section 30 that extends in a direction away from the fixing section 21 in the advancing direction D1, a brush support section 40 supported by the connecting section 30, and a brush section 50 supported by the brush support section 40.

The fixing sections 21, for example, are brackets made of a material such as metal, and are respectively provided at the outer positions in the vehicle width direction D2 of the guide frame 17. Here, the shape of the fixing section 21 is not limited to illustrated shape, and the material of the fixing section 21 may be a material other than metal.

Further, the fixing section 21 is provided with an upper shaft section 21*a* that extends in the vehicle width direction D2 at the upper end portion, a lower shaft section 21*b* that extends in the vehicle width direction D2 at the lower end portion, and an intermediate shaft section 21*c* that extends in the vehicle width direction D2 below the upper shaft section 21*a* and above the lower shaft section 21*b*.

The brush section 50 is disposed in front of the front guide frame 17 of the vehicle body 10, and is disposed behind the rear guide frame 17.

Hereinafter, because the removal devices 20 are provided symmetrically on the front and rear sides of the vehicle body 10, a removal device 20X provided at the front portion of the vehicle body 10 will be representatively described.

The brush section 50 extends obliquely downward toward the front side in the advancing direction D1 and is provided so that its lower end can come into contact with the road surface 4*a*.

An inclination angle $\alpha$ of the brush section 50 to the road surface 4*a*, for example, is approximately 85 degrees.

Furthermore, the brush section 50 of the removal device 20X provided at the front portion in the advancing direction D1 is provided to be inclined rearward from the front section in the advancing direction D1, toward the outer side from the inner side in the vehicle width direction D2 in the present embodiment. Here, the brush section 50 may be provided to be parallel to the vehicle width direction D2, without being inclined in the advancing direction D1 toward the outer side from the inner side in the vehicle width direction D2.

In the present embodiment, the brush section 50, for example, has a brush body 52 in which a plurality of linear members 51 made of a resin material such as polyethylene are bundled and fixed to each other. A diameter dimension of the linear members 51, for example, is approximately 2 mm. By bundling approximately twenty-five linear members 51, a bundled brush body 52 is formed.

More specifically, in the present embodiment, the brush section 50 has a first brush group 52*a* with a plurality of brush bodies 52 aligned side by side, a second brush group 52*b* with a plurality of brush bodies 52 aligned side by side and disposed to be adjacent to the first brush group 52*a*, and a binding member 53 that binds the first brush group 52*a* and the second brush group 52*b*.

The first brush group 52*a* is a group in which the plurality of brush bodies 52 are aligned side by side in the vehicle width direction D2, and the brush bodies 52 become a clump.

The second brush group 52*b* is a group in which the plurality of brush bodies 52 of substantially the same quantity as the first brush group 52*a* are aligned side by side in the vehicle width direction D2, and the brush bodies 52 become a clump. The second brush group 52*b* in the removal device 20X is provided to be adjacent to the rear side in the advancing direction D1 of the first brush group 52*a*.

The binding member 53 is a binding band made of resin, a metal member or the like which covers the first brush group 52*a* and the second brush group 52*b* along the outer circumference, and binds the first and second brush groups. The binding member 53 binds the first brush group 52*a* and the second brush group 52*b* at two locations spaced apart from each other in the height direction D3, at a position spaced apart from the lower ends of the first brush group 52*a* and the second brush group 52*b* in the height direction D3 of the vehicle body 10.

Next, the brush support section 40 will be described.

Figure 4:
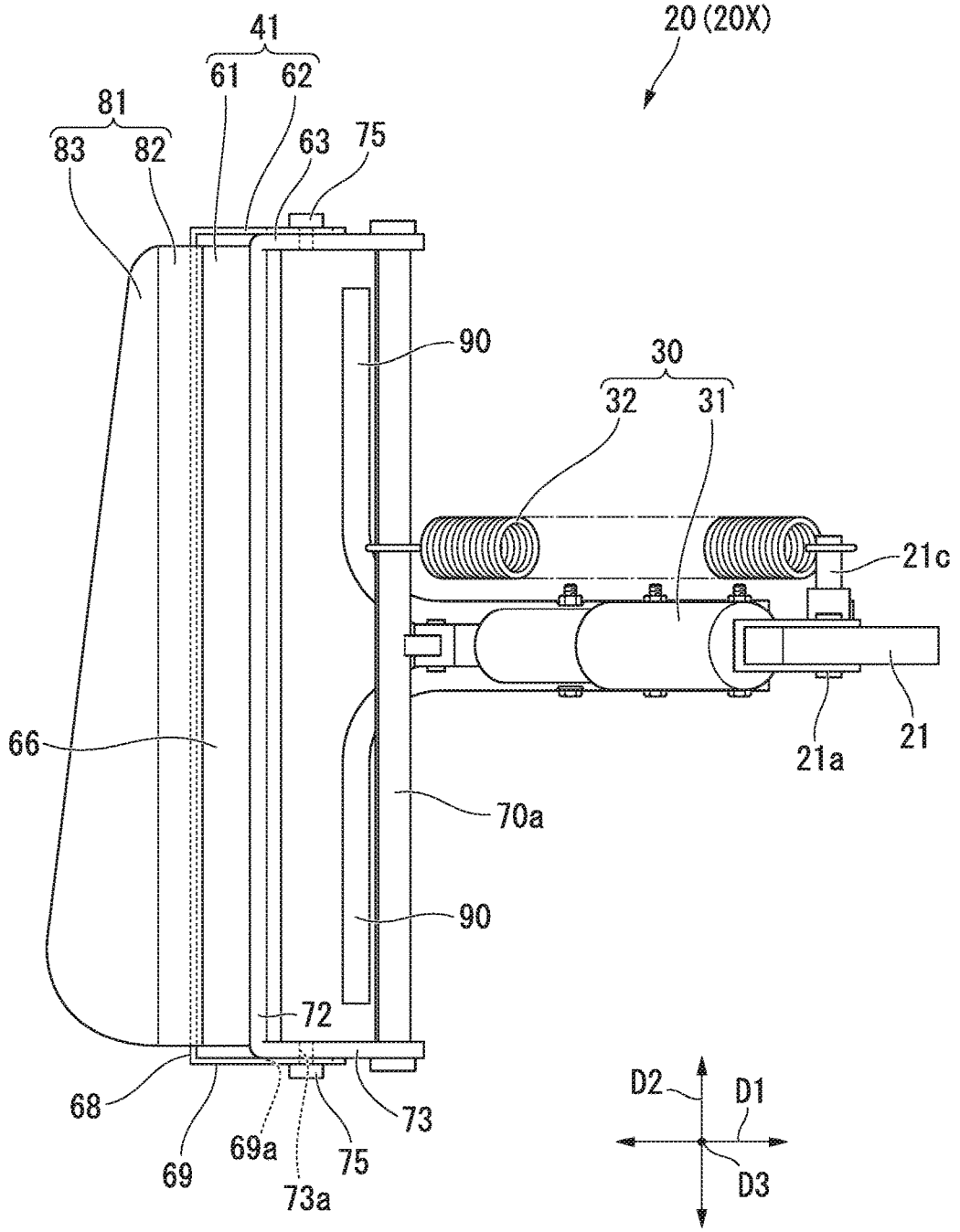
FIG. 4 is a side view illustrating a device for removing the object on the road surface provided in the guide rail type vehicle according to an embodiment of the present invention, and a sectional view taken along a line A-A of FIG. 2.
Figure 5:
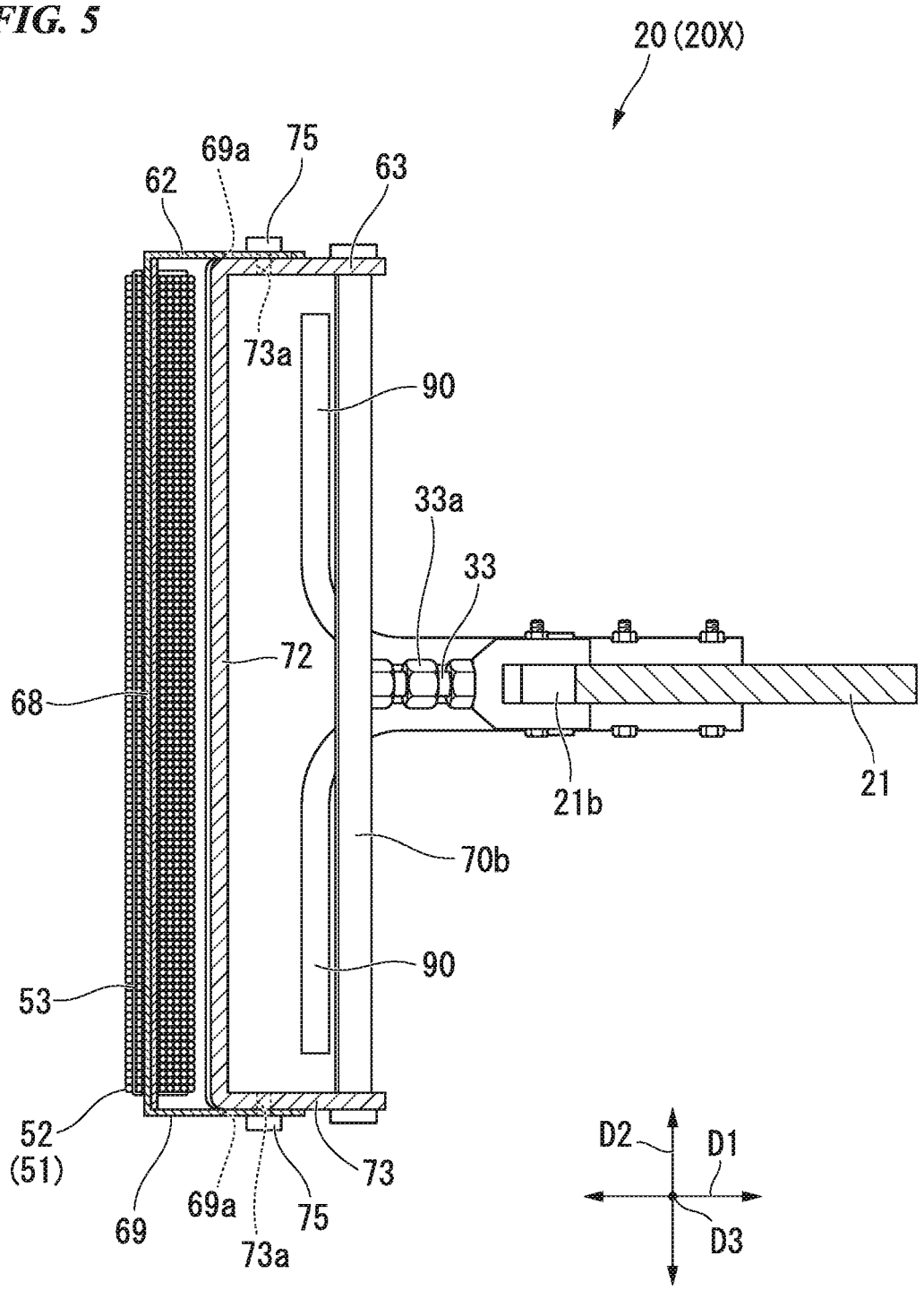
FIG. 5 is a side view illustrating a device for removing the object on the road surface provided in the guide rail type vehicle according to an embodiment of the present invention, and a sectional view taken along a line B-B of FIG. 2.

As illustrated in FIGS. 2 to 4, the brush support section 40 of the removal device 20X has a gripping section 41 that grips an upper portion of the brush body 52 to interpose the upper portion from the front and rear in the advancing direction D1, and a snow plow section 42 which protrudes forward in the advancing direction D1 from the gripping section 41 and the first brush group 52*a* of the brush body 52.

The gripping section 41 has an upper bracket 61 that surrounds the upper end of the brush body 52 from the top, the front, and the rear, a side bracket 62 that surrounds the brush body 52 from the front and both sides in the vehicle width direction D2, and a rear bracket 63 that is fixed to the side bracket 62 and extends rearward in the advancing direction D1. The gripping section 41, for example, is formed of a material such as metal.

The upper bracket 61 is a member that forms a U-shape when viewed from the vehicle width direction D2. Specifically, the upper bracket 61 has a front plate 65 that is disposed in front of the first brush group 52*a* and provided to extend along the direction of extension of the linear member 51 of the brush body 52, an upper plate 66 that covers the upper surface of the brush body 52 continuously with the front plate 65 so as to be bent from the front plate 65, and a rear plate 67 that is disposed behind the second brush group 52*b* continuously with the upper plate 66 so as to be bent from the upper plate 66 and is provided to extend in the extended direction of the linear member 51.

The side bracket 62 has a front plate 68 provided in front of the front plate 65 of the upper bracket 61, a pair of side plates 69 that extends rearward continuously with the front plate 68 so as to be bent from both ends in the vehicle width direction D2 of the front plate 68, and a shaft section 70 provided between the pair of side plates 69.

The front plate 68 is further provided so as to cover the front plate 65 of the upper bracket 61 from the front side.

The pair of side plates 69 extends further rearward from the second brush group 52*b* of the brush body 52 along the brush body 52. In each of the side plates 69, two mounting holes 69*a* passing through in the vehicle width direction D2 are provided at positions spaced apart from each other in the height direction D3 of the vehicle body 10. The mounting holes 69*a* are formed in a long hole shape extending in the advancing direction D1.

The shaft section 70 is a member that is interposed between the pair of side plates 69 and extends in the vehicle width direction D2. The shaft section 70 has an upper shaft section 70*a* which is provided on the upper portion of the side plate 69, and a lower shaft section 70*b* which is provided below the upper shaft section 70*a* to be parallel to the upper shaft section 70*a*.

The rear bracket 63 has a back plate 72 that is provided behind the second brush group 52*b* of the brush body 52, and a pair of side plates 73 that extends rearward continuously with the back plate 72 so as to be bent from both ends in the vehicle width direction D2 of the back plate 72.

The rear plate 72 is provided to cover the rear plate 67 of the upper bracket 61 from the rear side.

Each of the side plates 73 is provided so as to be interposed from the vehicle width direction D2 by a pair of side plates 69 of the side bracket 62. Further, in the side plate 73, two through-holes 73*a* passing through in the vehicle width direction D2 are provided at positions spaced apart from each other in the height direction D3 of the vehicle body 10. The through-holes 73*a* are formed at the positions corresponding to the mounting holes 69*a* of the side plate 69 of the side bracket 62. Further, when bolts 75 are inserted through the mounting holes 69*a* and the through-holes 73*a* to fix the side bracket 62 and the rear bracket 63, the brush body 52 is interposed in the advancing direction D1 by the rear plate 67 of the rear bracket 63 and the front plate 68 of the side bracket 62, and the brush section 50 is supported by being fixed to the gripping section 41.

The snow plow section 42 has a mounting section 80 provided between the side bracket 62 and the upper bracket 61 in the gripping section 41, and a plow body portion 81 that extends forward continuously with the mounting section 80 so as to bent from the upper end of the mounting section 80.

The mounting section 80 is disposed in front of the brush body 52, has a plate shape, is interposed between the front plate 68 of the side bracket 62 and the front plate 65 of the upper bracket 61, and is provided so as to be fixed to the gripping section 41 and the brush section 50.

The plow body portion 81 is formed in a plate shape extending along the bottom surface of the body portion 11 of the vehicle body 10, i.e. along the road surface 4*a*. More specifically, the plow body portion 81 has a base plate 82 that extends upward toward the front side in the advancing direction D1 from the upper end of the mounting section 80, and a tip plate 83 that is bent from the base plate 82 and extends forward along the road surface 4*a* continuously with the base plate 82. The length dimension of the tip plate 83 extending along the advancing direction D1 becomes smaller toward the outer side in the vehicle width direction D2.

Next, the connecting section 30 will be described.

As illustrated in FIGS. 2 to 5, the connecting section 30 of the removal device 20X is interposed between the brush support section 40 and the fixing section 21 to connect the brush support section 40 to the fixing section 21.

In the present embodiment, the connecting section 30 has a cylinder 31 and an elastic member 32 that are interposed between the upper shaft section 21*a* of the fixing section 21 and the upper shaft section 70*a* of the brush support section 40, and an adjusting member 33 that is interposed between the lower shaft section 21*b* of the fixing section 21 and the lower shaft section 70*b* of the brush support section 40.

The cylinder 31 is a pneumatic cylinder or a hydraulic cylinder which is connected to the upper shaft section 21*a* of the fixing section 21, extends downward toward the front side in the advancing direction D1 from the fixing section 21, and is connected to the upper shaft section 70*a* of the gripping section 41. The cylinder 31 freely extends and contracts in an extending direction by a power source (not illustrated). That is, the cylinder 31 is provided to be relatively turnable with respect to the brush support section 40 and the fixing section 21, around an axis extending along the vehicle width direction D2 (an axis of the upper shaft section 21*a* of the fixing section 21, and an axis of the upper shaft section 70*a* of the gripping section 41).

The elastic member 32, for example, is a coil spring or the like that is connected to the intermediate shaft section 21*c* of the fixing section 21, extends downward toward the front side in the advancing direction D1 from the fixing section 21, and is connected to the upper shaft section 70*a* of the gripping section 41. The elastic member 32 is provided at a position shifted from the cylinder 31 in the vehicle width direction D2 so as not to interfere with the cylinder 31. Also, the elastic member 32 imparts a restoring force (elastic force) to the cylinder 31 in the direction of contraction of the cylinder 31 when the cylinder 31 extends.

The adjusting member 33 is connected to the lower shaft section 21*b* of the fixing section 21, extends forward in the advancing direction D1 from the fixing section 21, and is connected to the lower shaft section 70*b* of the gripping section 41. The adjusting member 33, for example, has an adjusting mechanism using a nut 33*a*. The adjusting member 33 is a rod-shaped member that is capable of extending and contracting in the advancing direction D1 by turning the nut 33*a*.

That is, the adjusting member 33 is provided to be interposed between the fixing section 21 and the brush support section 40 at a position different from the cylinder 31 in the vertical direction (and a height direction D3) so as to be relatively turnable about the axis (the axis of the lower shaft section 21*b* of the fixing section 21, and the axis of the lower shaft section 70*b* of the gripping section 41) extending in the vehicle width direction D2 with respect to the brush support section 40 and the fixing section 21.

Here, in the present embodiment, the removal device 20 further includes a brush back support section 90 that is capable of coming into contact with the back side facing the rear side in the advancing direction D1 of the second brush group 52*b* in the brush body 52, when the brush section 50 is located at a retracted position P2 to be described below.

Figure 6:
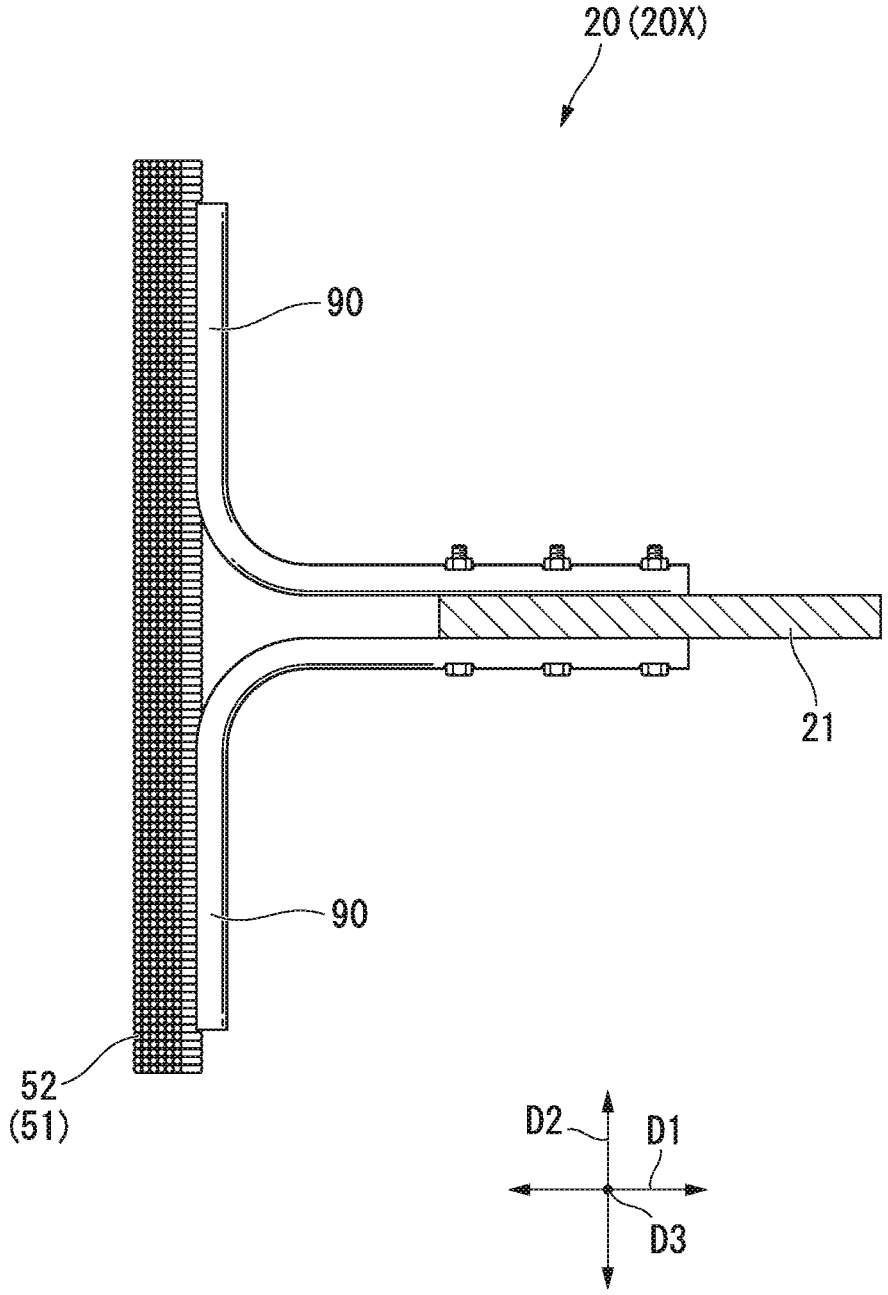
FIG. 6 is a side view illustrating a device for removing the object on the road surface provided in the guide rail type vehicle according to an embodiment of the present invention, and a sectional view taken along a line C-C of FIG. 3.

As illustrated in FIGS. 3 and 6, the brush back support section 90 has a round rod shape that is mounted to the fixing section 21 and extends toward the back side of the second brush group 52*b* of the brush body 52, at a position below the lower shaft section 21*b* of the fixing section 21 at the retracted position P2. More specifically, a pair of brush back support sections 90 is provided to be apart from each other in the vehicle width direction D2. Further, each of the brush back support sections 90 extends forward in the advancing direction D1 from the fixing section 21. The pair of brush back support sections 90 bends and extends in a direction away from each other in the vehicle width direction D2 at a position close to the brush body 52. However, the brush back support section 90 is not limited to the aforementioned shape.

Next, the operation between a use position P1 and the retracted position P2 of the brush section 50 of the removal device 20X will be described with reference to FIGS. 2 and 3.

As illustrated in FIG. 2, when the brush section 50 is used at the use position P1, the cylinder 31 is in a state of extending forward in the advancing direction D1. At this time, the lower end of the brush body 52 of the brush section 50 is in a state of just coming into contact with the road surface 4*a*. Moreover, the length of the adjusting member 33 is adjusted so that the inclination angle $\alpha$ of the brush body 52 to the road surface 4*a* is preferably set to 85 degrees.

At the use position P1, the brush back support section 90 is disposed at a position spaced apart from the brush body 52. Further, the elastic member 32 is in a state in which the restoring force is generated in a direction of pulling the brush support section 40 toward the fixing section 21. That is, the elastic member 32 is in a state of being extended as compared to a natural length in the case in which the elastic member 32 is a spring.

As illustrated in FIG. 3, when the brush section 50 is used at the retracted position P2, the cylinder 31 is in a state of being contracted as compared to the use position P1. At this time, the lower end of the brush body 52 of the brush section 50 is in a state spaced apart from the road surface 4*a* in the vertical direction D3 of the vehicle body 10.

At the retracted position P2, the brush body 52 is located at a position closer to the fixing section 21 than in the use position P1, and the brush body 52 is supported by the brush back support section 90 in a state in which the back side of the second brush group 52*b* of the brush body 52 is in contact with the brush back support section 90. Further, the adjusting member 33 is disposed to extend upward toward the front side in the advancing direction D1 from the fixing section 21.

Further, when the brush section 50 moves to the retracted position P2 from the use position P1, the power of the cylinder 31 is turned OFF to contract the cylinder 31 so that the brush section 50 approaches the fixing section 21 by the restoring force generated in the elastic member 32, at the use position P1.

Figure 7:
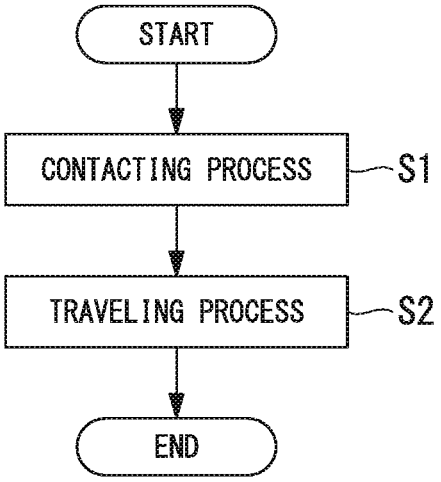
FIG. 7 is a flow chart illustrating a process of a method for removing the object on the road surface using the brush section of the device for removing the object on the road surface according to an embodiment of the present invention.

According to the vehicle 1 of the present embodiment described above, the cylinder 31 of the removal device 20 is first operated. Further, the brush section 50 is disposed at the use position P1 to bring the surface of the lower end of the brush body 52 into contact with the road surface 4*a* (contacting process S1 of FIG. 7). The vehicle body 10 is made to travel in this state (traveling process S2 of FIG. 7).

In the present embodiment, the brush section 50 of the removal device 20 extends obliquely forward to come into contact with the road surface 4*a*. Thus, when the vehicle body 10 travels, the brush section 50 does not advance to simply stroke the road surface 4*a*. Further, it is possible to scrub and remove the object from the road surface 4*a*.

Furthermore, when the lower end of the brush section 50 comes into contact with the road surface 4*a*, the lower end is caught at the rear side in the advancing direction D1 so that the lower end is pulled to the road surface 4*a* by frictional force received from irregularities and the like on the surface of the road surface 4*a*. Thereafter, the lower end of the brush section 50 tries to return to the front side by the restoring force of the brush section 50 itself again and acts to flick the road surface 4*a*. By such an action, it is possible to flick off the object from the road surface 4*a*. Thus, for example, it is also possible to easily remove the object on the road surface such as compacted snow that is hard to remove. Thus, with a simple mechanism in which the brush section 50 is provided to come into contact with the road surface 4*a*, while being inclined to extend obliquely forward, it is possible to remove the object on the road surface, without providing another operating mechanism.

Furthermore, it is possible to change the inclination angle of the brush section 50 and the brush support section 40 by the adjusting member 33 of the connecting section 30. Specifically, the adjusting member 33 is provided at a position shifted from the cylinder 31 in the vertical direction. For this reason, by extending and contracting the adjusting member 33, the brush support section 40 turns about the upper shaft section 70*a* by which the cylinder 31 is connected to the brush support section 40, as the turning center.

By turning of the brush support section 40, it is possible to easily change the inclination angle of the brush section 50 to the road surface 4*a*. Therefore, it is possible to adjust the contact angle of the brush to the road surface 4*a* in accordance with the state of the object on the road surface 4*a*. Thus, it is possible to more effectively remove the object on the road surface.

In addition, it is possible to easily dispose the brush section 50 at the use position P1 by pushing the brush section 50 forward by the cylinder 31 of the connecting section 30, or it is possible to easily dispose the brush section 50 at the retracted position P2 by pulling the brush section 50 to the vehicle body 10 side by the elastic member 32 of the connecting section 30.

Further, because the brush back support section 90 comes into contact with the back side of the brush section 50 at the retracted position P2 of the brush section 50, it is possible to firmly fix the brush section 50 at the retracted position P2. Therefore, it is possible to suppress rattling of the brush section 50 even when the brush section 50 is not used during traveling of the vehicle body 10.

Further, the brush body 52, in which the linear members 51 are provided in a plurality of bundles and fixed to each other, is provided in the brush section. Accordingly, when the vehicle body 10 advances, while the lower end of the brush section 50 comes into contact with the road surface 4*a*, each linear member 51 is intricately operated. Therefore, it is possible to further enhance the effect in which the brush body 52 flicks the road surface 4*a*. As a result, it is possible to further effectively flick off and remove the object from the road surface 4*a*.

Furthermore, the vehicle 1 of the present embodiment is provided with the snow plow section 42, and the brush section 50 of the removal device 20X provided at the front portion in the advancing direction D1 is provided obliquely rearward from the front in the advancing direction D1 toward the outer side from the inner side in the vehicle width direction D2 in the present embodiment. Therefore, it is possible to remove the object removed from the road surface 4*a* so that it is pushed outward in the vehicle width direction D2. Therefore, the object on the road surface after the removal does not impede the traveling of the vehicle 1.

Further, since the mounting hole 69*a* of the side bracket 62 of the gripping section 41 has a long hole shape, it is possible to fix the brush section 50 to the gripping section 41 regardless of the dimensional tolerance of the brush body 52.

Furthermore, because the binding member 53 is provided and the brush body 52 is fixed to the brush support section 40 at the middle position between the upper end and the lower end of the brush body 52, when the lower end of the linear member 51 is caught at the rear side in the advancing direction D1, it is easy to obtain a restoring force by which the lower end of the linear member 51 tries to return to the front side. Therefore, it is possible to further enhance the effect in which the brush body 52 flicks the road surface 4*a*, and it is possible to further improve the effect of removing the object on the road surface.

While embodiments of the present invention have been described in detail with reference to the accompanying drawings, each configuration, combinations thereof and the like in each embodiment are an example, and additions, omissions, substitutions and other modifications can be made within a scope that does not depart from the spirit of the present invention. Further, the present invention is only limited by the appended claims rather than being limited by the embodiments.

Figure 8:
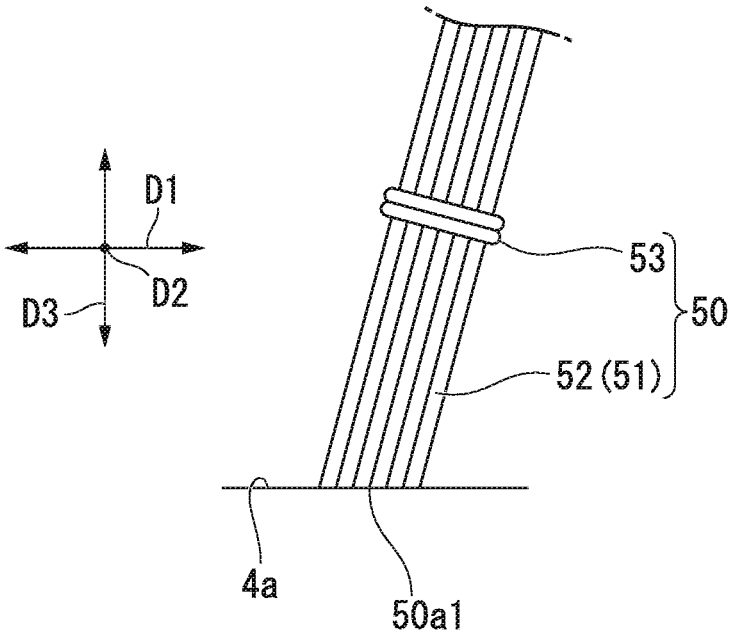
FIG. 8 is a side view illustrating a first modified example of the brush section of the device for removing the object on the road surface according to an embodiment of the present invention, illustrating a state during traveling.

For example, as illustrated in FIG. 8, a lower end surface 50*a*1 of the brush body 52 of the brush section 50 may be formed to extend along the road surface 4*a* at the use position P1, and preferably, to be parallel to the road surface 4*a*. That is, the lower end surface 50*a*1 may be an inclined surface that is obliquely cut with respect to the extension direction of the brush body 52. In this case, since the lower end surface 50*a*1 of the brush section 50 extends along the road surface 4*a*, the entire lower end surface 50*a*1 of the brush section 50 can be brought into contact with the road surface 4*a*. Therefore, it is possible to more effectively remove the object on the road surface 4*a*.

Figure 9A:
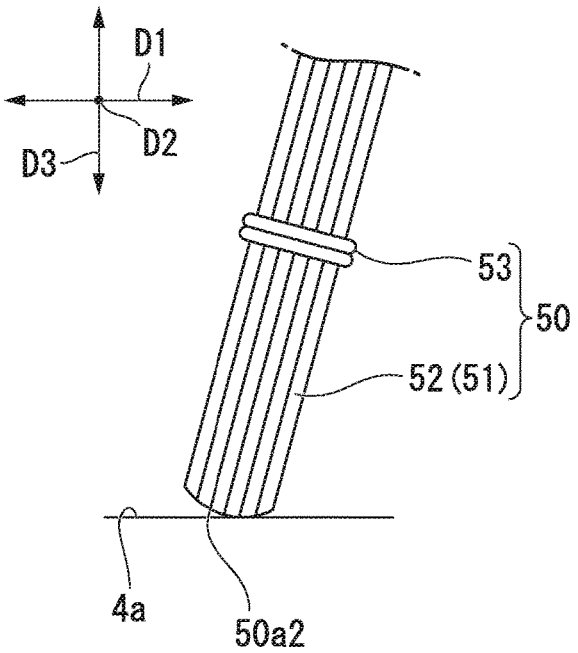
FIG. 9A is a side view illustrating a second modified example of the brush section of the device for removing the object on the road surface according to an embodiment of the present invention, illustrating a state during traveling and illustrating a case where the brush section is inclined forward in the advancing direction.
Figure 9B:
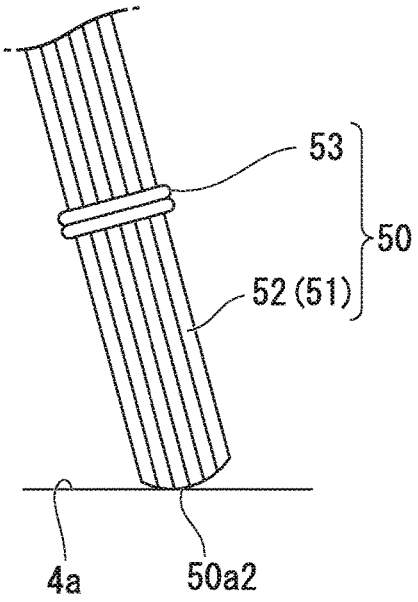
FIG. 9B is a side view illustrating a second modified example of the brush section of the device for removing the object on the road surface according to an embodiment of the present invention, illustrating a state during traveling and illustrating a case where the brush section is inclined rearward in the advancing direction.

Further, as illustrated in FIGS. 9A and 9B, a lower end surface 50*a*2 of the brush body 52 of the brush section 50 may be provided in an arc shape that forms a convex shape toward the downward direction. Here, the length of the adjusting member 33 is adjusted so that the state in which the brush section 50 is inclined to extend downward toward the front side in the advancing direction D1 as illustrated in FIG. 9A is changed to the state in which the brush section 50 is inclined to extend downward toward the rear side in the advancing direction D1 as illustrated in FIG. 9B. Even in such a case, since the lower end surface of the brush body 52 has a convex shape, the lower end surface 50*a*2 of the brush section 50 can be easily brought into contact with the road surface 4*a*. When the brush section 50 is inclined rearward as illustrated in FIG. 9B, it is possible to remove the object on the road surface such as deposited snow so as to stroke the road surface 4*a*.

Further, since the lower end surface 50*a*2 of the brush body 52 is provided in an arc shape that forms a convex shape toward the downward direction, even in the case of changing the inclination angle of the brush section 50 as well as the case of changing the inclination direction, the brush section 50 can be brought into contact with the road surface 4*a* in a wide range of the lower end surface. Thus, it is possible to further enhance the effect of removing the object on the road surface.

Figure 10:
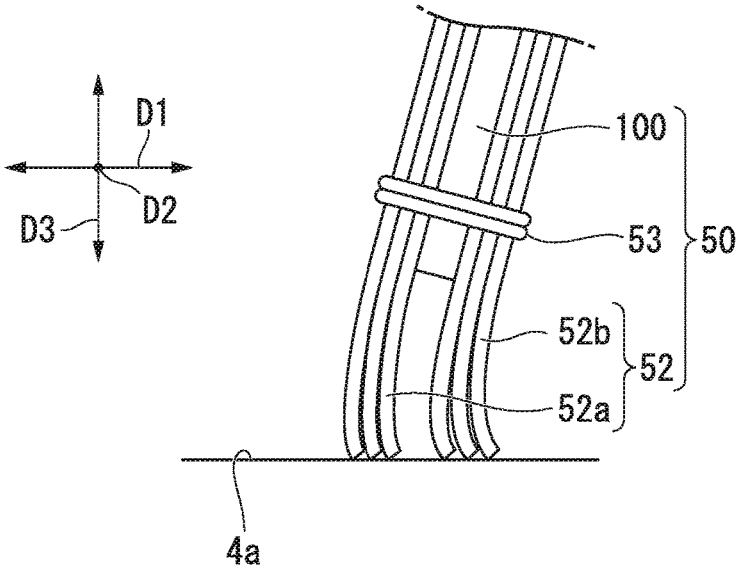
FIG. 10 is a side view illustrating a third modified example of the brush section of the device for removing the object on the road surface according to an embodiment of the present invention, and illustrating a state during traveling.

Furthermore, as illustrated in FIG. 10, the first brush group 52*a* and the second brush group 52*b* may be bound with a gap in the advancing direction D1. Specifically, the brush section 50 further has a spacer 100 provided between the first brush group 52*a* and the second brush group 52*b*. The spacer 100 is provided to be interposed between the first brush group 52*a* and the second brush group 52*b* from the advancing direction D1 at a position spaced upward from the lower end surface 50*a*3 of the brush body 52.

By providing the spacer 100 in this way, the first brush group 52*a* and the second brush group 52*b* are provided at a gap. Accordingly, as compared to a case where the first brush group 52*a* and the second brush group 52*b* are bound together with no gap, when the vehicle body 10 advances while the brush body 52 comes into contact with the road surface 4*a*, the lower ends of the first brush group 52*a* and the second brush group 52*b* are easily operated, respectively. Accordingly, it is possible to further enhance an effect in which each linear member 51 constituting the first brush group 52*a* and the second brush group 52*b* is more intricately operated, and the brush section 50 flicks the road surface 4*a*. As a result, it is possible to further effectively flick off and remove the object from the road surface 4*a*. Here, for example, a brush group having a length shorter than those of the first brush group 52*a* and the second brush group 52*b* may be used as the spacer 100.

Further, in the removal device 20 of the rear portion in the advancing direction D1, the vehicle 1 may travel while disposing the brush section 50 at the retracted position P2 or the vehicle 1 may travel while disposing the brush section 50 at the use position P1.

Furthermore, for example, vibrations may be added to the brush section 50 by controlling the cylinder 31 during traveling.

Further, the binding member 53 may not be necessarily provided. The brush body 52 may be directly fixed to the brush support section 40 without providing the binding member 53. In this case, the position of fixing the brush body 52 to the brush support section 40 may be a middle position between the upper end and the lower end of the brush body.

Further, the connecting section 30 may not have the cylinder 31, the elastic member 32, and the adjusting member 33. For example, the connecting section 30 may be a mere bracket. In this case, it may be possible to change the inclination angle of the brush body 52 by a bracket replacement or the like.

What is claimed is:

1. A device for removing an object on a road surface, the device comprising:

a brush section which is provided between an end portion in an advancing direction of a vehicle body of a guide rail type vehicle that travels on the road surface, and a traveling wheel provided below the vehicle body, wherein the brush section comprises a brush body in which a plurality of linear members are bundled, and a lower end of the brush body is positioned closer to the end portion of the vehicle body than an upper end of the brush body at a use position in which the lower end of the brush body is configured to come into contact with the road surface.

2. The device for removing the object on the road surface according to claim 1, further comprising:

a brush support section that fixes the brush section;

a fixing section fixed to the vehicle body; and a connecting section that is interposed between the brush support section and the fixing section to connect the brush support section to the fixing section, wherein the connecting section connects the brush support section to the fixing section to allow a change in inclination angle of the brush section and the brush support section to the road surface.

3. The device for removing the object on the road surface according to claim 2, wherein the connecting section comprises:

a cylinder that is interposed between the fixing section and the brush support section to be relatively turnable about an axis extending in a width direction of the vehicle body with respect to the brush support section and the fixing section, and is extendable and contractable along the advancing direction of the vehicle body; and an adjusting member that is interposed between the fixing section and the brush support section at a position different from the cylinder in the vertical direction to be relatively turnable about the axis extending in the width direction of the vehicle body with respect to the brush support section and the fixing section, and is extendable and contractable in the advancing direction of the vehicle body.

4. The device for removing the object on the road surface according to claim 3, further comprising:

a brush back support section that is provided at the fixing section, and is capable of supporting the brush section by coming into contact with the brush section at a retracted position of the brush section when the cylinder is contracted.

5. The device for removing the object on the road surface according to claim 1, wherein a surface of the lower end of the brush section is provided to extend along the road surface, at the use position in which the brush section is capable of coming into contact with the road surface.

6. The device for removing the object on the road surface according to claim 1, wherein the surface of the lower end of the brush section is provided in a circular arc shape that forms a convex shape toward a downward direction.

7. The device for removing the object on the road surface according to claim 1, wherein the brush body is fixed to the brush support section which fixes the brush section to the vehicle body, at a position between the upper and lower ends of the brush body.

8. The device for removing the object on the road surface according to claim 1, wherein the brush section comprises a binding member that fixes the plurality of linear members at a position between the upper and lower ends of the brush body.

9. The device for removing the object on the road surface according to claim 1, wherein the brush section comprises:

a first brush group in which a plurality of brush bodies are aligned side by side in the width direction of the vehicle body;

a second brush group in which a plurality of brush bodies are aligned side by side in the width direction of the vehicle body and are disposed to be adjacent to the first brush group in the advancing direction; and a binding member that binds the first brush group and the second brush group, wherein the first brush group and the second brush group are bound by the binding member with a gap in the advancing direction.

10. A guide rail type vehicle comprising:

the device for removing the object on the road surface according to claim 1; and the vehicle body that fixes the device for removing the object on the road surface.

11. A method for removing an object on a road surface, the method comprising:

bringing a lower end of the brush section into contact with the road surface on which a vehicle body of a guide rail type vehicle travels; and causing the vehicle body to travel, while bringing the brush section into contact with the road surface, wherein the brush section comprises a brush body in which a plurality of linear members are bundled and which is provided between an end portion in an advancing direction of the vehicle body, and a traveling wheel provided below the vehicle body, and a lower end of the brush body is positioned closer to the end portion of the vehicle body than an upper end of the brush body while bringing the brush section into contact with the road surface.

* * * * *